US011460025B2

(12) United States Patent
Sata

(10) Patent No.: US 11,460,025 B2
(45) Date of Patent: Oct. 4, 2022

(54) SCROLL COMPRESSOR

(71) Applicant: DAIKIN INDUSTRIES, LTD., Osaka (JP)

(72) Inventor: Kenichi Sata, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/531,139

(22) Filed: Nov. 19, 2021

(65) Prior Publication Data

US 2022/0074411 A1 Mar. 10, 2022

Related U.S. Application Data

(63) Continuation of application No. PCT/JP2020/003251, filed on Jan. 29, 2020.

(30) Foreign Application Priority Data

May 24, 2019 (JP) ..... JP2019-097712

(51) Int. Cl.
*F01C 1/02* (2006.01)
*F04C 18/02* (2006.01)

(52) U.S. Cl.
CPC ..... *F04C 18/0215* (2013.01); *F04C 18/0246* (2013.01); *F04C 18/0253* (2013.01); *F04C 2240/56* (2013.01); *F04C 2240/60* (2013.01)

(58) Field of Classification Search
CPC ..... F04C 18/00246; F04C 18/0253; F04C 18/0215
USPC ..... 418/55.1–55.5
See application file for complete search history.

(56) References Cited

U.S. PATENT DOCUMENTS

| | | | | |
|---|---|---|---|---|
| 5,496,158 | A | 3/1996 | Barito et al. | |
| 6,179,591 | B1 | 1/2001 | Clendenin et al. | |
| 10,634,140 | B2 * | 4/2020 | Kuwahara | F04C 18/0276 |
| 2014/0050013 | A1 | 2/2014 | Wei et al. | |

(Continued)

FOREIGN PATENT DOCUMENTS

| | | | |
|---|---|---|---|
| CN | 106401968 | A | 6/2001 |
| CN | 1302954 | A | 7/2001 |

(Continued)

OTHER PUBLICATIONS

International Preliminary Report of corresponding PCT Application No. PCT/JP2020/003251 dated Dec. 2, 2021.

(Continued)

*Primary Examiner* — Deming Wan
(74) *Attorney, Agent, or Firm* — Global IP Counselors, LLP

(57) ABSTRACT

A scroll compressor includes a scroll compression element including a movable scroll, a drive shaft configured to allow the movable scroll to rotate, a boss portion, and a sliding bearing. The boss portion is connected to a back surface of the movable scroll. The boss portion is configured to rotatably support an upper end portion of the drive shaft. The upper end of the drive shaft is configured as an eccentric shaft portion. The sliding bearing is provided between the boss portion and the eccentric shaft portion. An axially central portion of the boss portion is more rigid than a connection portion of the boss portion connected to the movable scroll. The boss portion is shaped so that the central portion projects outward.

10 Claims, 4 Drawing Sheets

(56) References Cited

U.S. PATENT DOCUMENTS

| | | | | |
|---|---|---|---|---|
| 2015/0147214 | A1* | 5/2015 | Nagahara ..... | F04C 29/028<br>418/55.2 |
| 2019/0368493 | A1 | 12/2019 | Kumakura et al. | |

FOREIGN PATENT DOCUMENTS

| | | | |
|---|---|---|---|
| EP | 0 537 884 | A1 | 4/1993 |
| EP | 3 567 254 | A1 | 11/2019 |
| JP | 4-72484 | A | 3/1992 |
| JP | 2001-153070 | A | 6/2001 |
| JP | 2010-43620 | A | 2/2010 |
| JP | 2014-163332 | A | 9/2014 |
| JP | 2018-112108 | A | 7/2018 |
| JP | 20180123691 | A | 8/2018 |
| WO | 2013/080452 | A1 | 6/2013 |
| WO | 2015/068308 | A1 | 5/2015 |

OTHER PUBLICATIONS

International Search Report of corresponding PCT Application No. PCT/JP2020/003251 dated Mar. 31, 2020.
European Search Report of corresponding EP Application No. 20 81 5247.0 dated May 10, 2022.

* cited by examiner

SCROLL COMPRESSOR

CROSS-REFERENCE TO RELATED APPLICATIONS

This is a continuation of International Application No. PCT/JP2020/003251 filed on Jan. 29, 2020, which claims priority to Japanese Patent Application No. 2019-097712, filed on May 24, 2019. The entire disclosures of these applications are incorporated by reference herein.

BACKGROUND

Field of Invention

The present disclosure relates to a scroll compressor.

Background Information

A scroll compressor mainly includes a motor and a compression element. The motor and the compression element are connected together through a drive shaft. The compression element includes a fixed scroll and a movable scroll driven by the motor to rotate.

An upper end portion of the drive shaft is configured as an eccentric shaft portion that is eccentric with respect to the drive shaft. The eccentric shaft portion is rotatably supported in a substantially cylindrical boss portion connected to the back surface of the movable scroll with a sliding bearing interposed between the eccentric shaft portion and the boss portion. Thus, the driving force of the drive shaft is transmitted to the movable scroll, which rotates.

The fixed and movable scrolls each have a spiral tooth. These spiral teeth mesh with each other. The volume of a compression chamber defined by the spiral teeth of the fixed and movable scrolls decreases gradually as the movable scroll rotates. Thus, a refrigerant gas supplied from the outside to the inside of the compression chamber is compressed.

SUMMARY

A first aspect of the present disclosure is directed to a scroll compressor including a scroll compression element including a movable scroll, a drive shaft configured to allow the movable scroll to rotate, a boss portion, and a sliding bearing. The boss portion is connected to a back surface of the movable scroll. The boss portion is configured to rotatably support an upper end portion of the drive shaft. The upper end of the drive shaft is configured as an eccentric shaft portion. The sliding bearing is provided between the boss portion and the eccentric shaft portion. An axially central portion of the boss portion is more rigid than a connection portion of the boss portion connected to the movable scroll. The boss portion is shaped so that the central portion projects outward.

DETAILED DESCRIPTION OF EMBODIMENT(S)

Embodiments of the present disclosure will be described below with reference to the drawings. The embodiments below are merely exemplary ones in nature, and are not intended to limit the scope, applications, or use of the invention.

Configuration of Scroll Compressor

Figure 1:
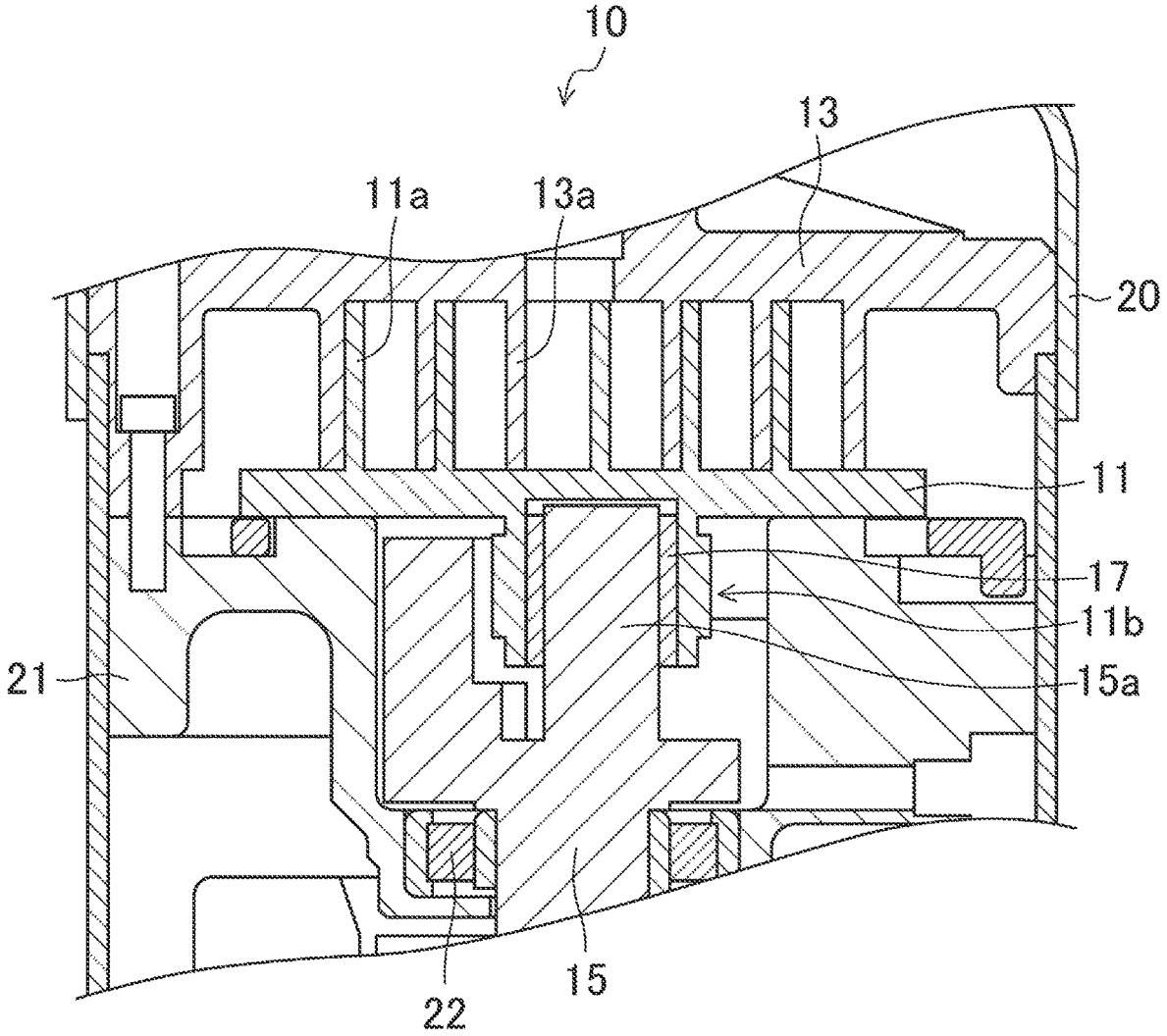
FIG. 1 is a cross-sectional view illustrating a portion of a configuration of a scroll compressor according to an embodiment.

FIG. 1 is a schematic cross-sectional view illustrating a portion of a configuration of a scroll compressor according to an embodiment.

The scroll compressor illustrated in FIG. 1 mainly includes a motor (not shown), a scroll compression element (10), and a drive shaft (15) that drives the motor. These components are housed in a closed container (20). The motor and the compression element (10) are separated from each other in the closed container (20) by an upper housing (21). An upper portion of the drive shaft (15) is supported by the upper housing (21) with a bearing (22) interposed therebetween. Although not shown, a lower portion of the drive shaft (15) is supported by a lower housing with another bearing interposed therebetween.

The compression element (10) includes a movable scroll (11) that rotates with the drive shaft (15), and a fixed scroll (13) fixed to the upper housing (21). The fixed scroll (13) is disposed above the movable scroll (11) to face the movable scroll (11). The movable and fixed scrolls (11) and (13) each include a spiral tooth (11*a*), (13*a*), which protrudes toward the other one of the movable and fixed scrolls (11) and (13).

An upper end portion of the drive shaft (15) is configured as an eccentric shaft portion (15*a*) that is eccentric with respect to the drive shaft (15). A substantially cylindrical boss portion (11*b*) is connected to a back surface of the movable scroll (11). The eccentric shaft portion (15*a*) is rotatably supported in the boss portion (11*b*) with a sliding bearing (17) interposed therebetween. Thus, the driving force of the drive shaft (15) is transmitted through the boss portion (11*b*) to the movable scroll (11), which revolves.

Revolution of the movable scroll (11) allows a compression chamber defined by the spiral teeth (11*a*) and (13*a*) of the movable and fixed scrolls (11) and (13) to move from the outer periphery toward the inner periphery of each scroll with the compression chamber being gradually reduced in volume. Thus, a refrigerant gas in the compression chamber is gradually compressed, so that the compression chamber reaches its innermost position. The compressed refrigerant gas is discharged from the compression chamber at its innermost position through an outlet of the compression chamber.

The drive shaft (15) may have an oil supply hole extending from a lower portion of the closed container (20) to the end face of the eccentric shaft portion (15*a*). Thus, oil can be guided from an oil reservoir in the lower portion of the closed container (20) through the oil supply hole to the end face of the eccentric shaft portion (15*a*), and can be supplied to sliding portions of the eccentric shaft portion (15*a*) and boss portion (11*b*).

Examples of the refrigerant compressed by the compression element (10) include a chlorine-free hydrofluorocarbon refrigerant as an alternative refrigerant.

Configuration of Boss Portion

Figure 2:
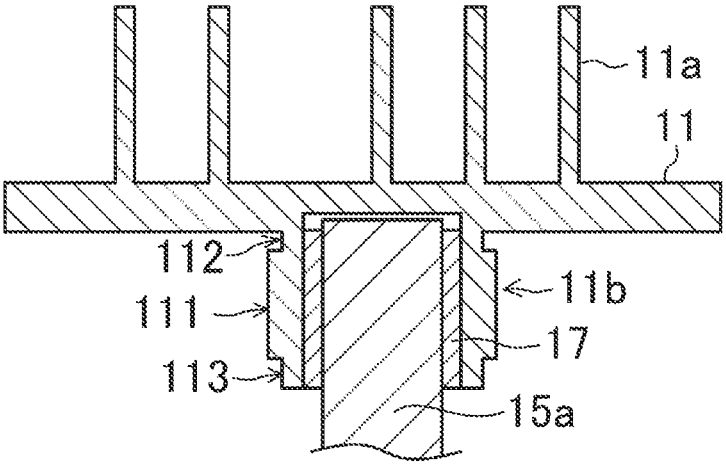
FIG. 2 is a cross-sectional view of a boss portion and its surrounding area of the scroll compressor illustrated in FIG. 1.

FIG. 2 illustrates a cross-sectional structure of the boss portion (11*b*) and its surrounding area of the scroll compressor illustrated in FIG. 1.

As illustrated in FIG. 2, an axially central portion (111) of the boss portion (11*b*) of the movable scroll (11) is thicker than each of a connection portion (112) of the boss portion (11*b*) connected to the movable scroll (11) and a distal end portion (113) of the boss portion (11*b*) is. In other words, the boss portion (11*b*) of the movable scroll (11) is shaped so that its central portion (111) projects outward.

This allows the central portion (111) of the boss portion (11*b*) to be more rigid than each of the connection portion (112) and the distal end portion (113) is.

Advantages of Embodiment

The scroll compressor of this embodiment allows the axially central portion (111) of the boss portion (11*b*) of the movable scroll (11) to be more rigid than the connection portion (112) of the boss portion (11*b*) connected to the movable scroll (11) is. This increases the ability of the central portion (111) of the boss portion (11*b*) to support a load. Thus, even if the eccentric shaft portion (15*a*) under the load associated with the rotational motion of the movable scroll (11) is deformed and is consequently inclined, it is possible to reduce the degree to which bearing stress from the eccentric shaft portion (15*a*) increases locally at the connection portion (112) of the boss portion (11*b*). Specifically, the axial distribution of the bearing stress on the boss portion (11*b*) can be equalized to reduce the bearing stress on the connection portion (112), thereby enhancing the ability of the entire sliding bearing (17) to support the load. This can reduce wear and seizure of the sliding bearing (17) near the connection portion (112) of the boss portion (11*b*) even under severe lubrication conditions.

The scroll compressor of this embodiment allows the axially central portion (111) of the boss portion (11*b*) of the movable scroll (11) to be more rigid than the distal end portion (113) is. This increases the ability of the central portion (111) of the boss portion (11*b*) to support a load. Thus, even if the eccentric shaft portion (15*a*) under the load associated with the rotational motion of the movable scroll (11) is deformed and is consequently inclined, it is possible to reduce the degree to which bearing stress from the eccentric shaft portion (15*a*) increases locally at the distal end portion (113) of the boss portion (11*b*). Specifically, the axial distribution of the bearing stress on the boss portion (11*b*) can be equalized to reduce the bearing stress on the distal end portion (113), thereby enhancing the ability of the entire sliding bearing (17) to support the load. This can reduce wear and seizure of the sliding bearing (17) near the distal end portion (113) of the boss portion (11*b*) even under severe lubrication conditions.

The scroll compressor of this embodiment allows the central portion (111) of the boss portion (11*b*) of the movable scroll (11) to be thicker than each of the connection portion (112) and the distal end portion (113) is. This allows the central portion (111) to be more rigid than each of the connection portion (112) and the distal end portion (113) is.

Comparative Example

Figure 3:
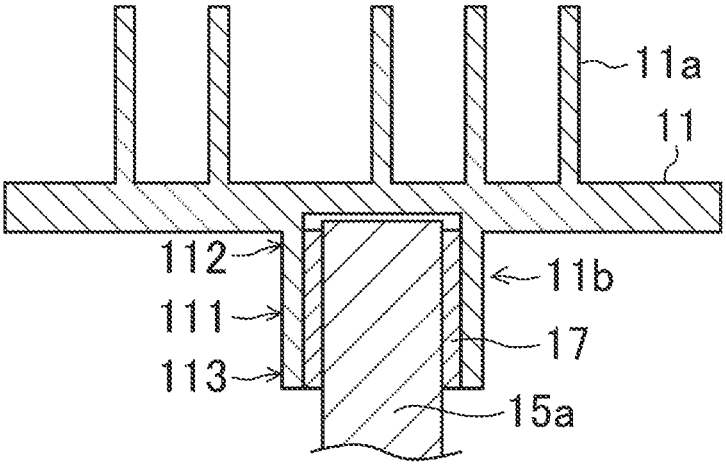
FIG. 3 is a cross-sectional view of a boss portion and its surrounding area of a scroll compressor according to a comparative example.

FIG. 3 is a cross-sectional view of a boss portion and its surrounding area of a scroll compressor according to a comparative example. It should be noted that, in FIG. 3, the same reference characters are used to designate the same elements as those in the embodiment illustrated in FIG. 1.

The scroll compressor of this comparative example is distinct from the scroll compressor of the embodiment illustrated in FIG. 1 in that as illustrated in FIG. 3, a boss portion (11*b*) of a movable scroll (11) has a thickness that is axially uniform. In other words, the boss portion (11*b*) of the movable scroll (11) has a central portion (111) equal in thickness to each of its connection portion (112) and its distal end portion (113). This allows the rigidity of the central portion (111) to be equal to that of each of the connection portion (112) and the distal end portion (113).

Thus, in the scroll compressor of this comparative example, if an eccentric shaft portion (15*a*) under the load associated with the rotational motion of the movable scroll (11) is deformed and is consequently inclined, bearing stress from the eccentric shaft portion (15*a*) increases locally at the connection portion (112) and distal end portion (113) of the boss portion (11*b*). This results in wear or seizure of the sliding bearing (17) near the connection portion (112) or distal end portion (113) of the boss portion (11*b*).

Figure 4:
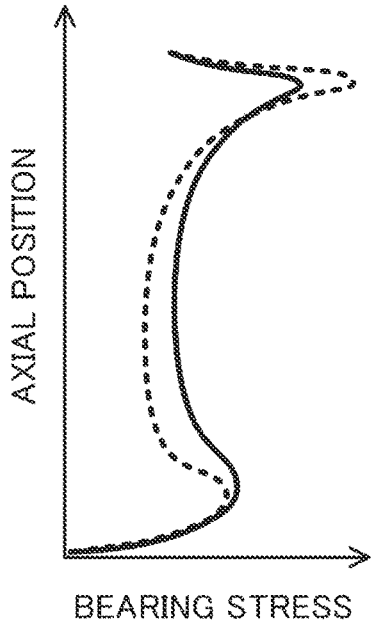
FIG. 4 shows the axial distribution of bearing stress on the boss portion of each of the scroll compressor according to the embodiment and the scroll compressor according to the comparative example.

FIG. 4 shows the axial distribution of bearing stress on the boss portion (11*b*) of each of the scroll compressor according to the embodiment illustrated in FIG. 1 and the scroll compressor according to this comparative example. In FIG. 4, the horizontal axis represents the magnitude of the bearing stress, and the vertical axis represents the axial position (the axial distance from the distal end of the boss portion (11*b*)). In FIG. 4, the solid curve indicates the axial distribution of the bearing stress on the boss portion (11*b*) of the scroll compressor of the embodiment illustrated in FIG. 1, and the broken curve indicates the axial distribution of the bearing stress on the boss portion (11*b*) of the scroll compressor of this comparative example.

The results shown in FIG. 4 were obtained in such a manner that reducing the rigidity of the entire boss portion (11*b*) makes it easier to localize the bearing stress on the connection portion (112) of the boss portion (11*b*) when the eccentric shaft portion (15*a*) is deformed and is consequently inclined.

As shown in FIG. 4, the axially central portion (111) of the boss portion (11*b*) of the scroll compressor of the embodiment, which is more rigid than the connection portion (112) is, can reduce the degree to which the bearing stress increases locally at the connection portion (112), as compared with the scroll compressor of this comparative example.

First Variation

Figure 5:
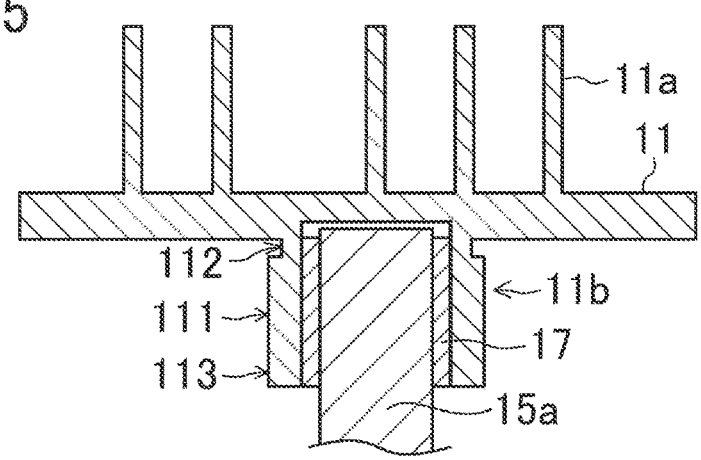
FIG. 5 is a cross-sectional view of a boss portion and its surrounding area of a scroll compressor according to a first variation.

FIG. 5 is a cross-sectional view of a boss portion and its surrounding area of a scroll compressor according to a first variation. It should be noted that, in FIG. 5, the same reference characters are used to designate the same elements as those in the embodiment illustrated in FIG. 1.

The scroll compressor of this variation is distinct from the scroll compressor of the embodiment illustrated in FIG. 1 in that as illustrated in FIG. 5, a central portion (111) of a boss portion (11*b*) of a movable scroll (11) is equal in thickness to a distal end portion (113) of the boss portion (11*b*). In other words, the central portion (111) and the distal end portion (113) have a greater thickness than a connection portion (112) does.

This allows the connection portion (112) of the boss portion (11*b*) to be less rigid than the other portion of the boss portion (11*b*).

Advantages of First Variation

For example, if the rigidity of the entire boss portion (11*b*) is low, and the deformation and resultant inclination of the eccentric shaft portion (15*a*) tend to localize the bearing stress on the connection portion (112), the scroll compressor of this variation described above can provide the following advantages. Specifically, the connection portion (112) of the boss portion (11*b*) is less rigid than the other portion of the boss portion (11*b*). This makes it more difficult for the bearing stress from the eccentric shaft portion (15*a*) to increase at the connection portion (112). This can further reduce wear and seizure of the sliding bearing (17) near the connection portion (112) of the boss portion (11*b*).

Second Variation

Figure 6:
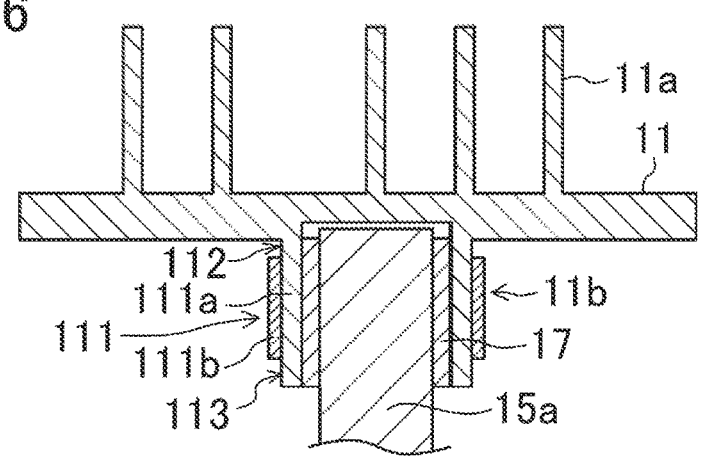
FIG. 6 is a cross-sectional view of a boss portion and its surrounding area of a scroll compressor according to a second variation.

FIG. 6 is a cross-sectional view of a boss portion and its surrounding area of a scroll compressor according to a second variation. It should be noted that, in FIG. 6, the same reference characters are used to designate the same elements as those in the embodiment illustrated in FIG. 1.

The scroll compressor of this variation is distinct from the scroll compressor of the embodiment illustrated in FIG. 1 in that as illustrated in FIG. 6, a central portion (111) of a boss portion (11*b*) of a movable scroll (11) has an inner portion (111*a*) made of a first material of which a connection portion (112) is made, and an outer portion (111*b*) made of a second material that is more rigid than the first material.

Examples of the first material forming the inner portion (111*a*) include aluminum. Examples of the second material forming the outer portion (111*b*) include steel.

For example, a portion of the boss portion (11*b*) except the outer portion (111*b*) is molded from the first material, and then the outer portion (111*b*) made of the second material is shrink-fitted to the inner portion (111*a*), thereby producing the scroll compressor of this variation.

Setting the inner portion (111*a*) of the boss portion (11*b*) to be thinner than each of the connection portion (112) and the distal end portion (113) may reduce the thickness of the central portion (111) as a combination of the inner and outer portions (111*a*) and (111*b*). For example, the thickness of the central portion (111) may be substantially equal to that of each of the connection portion (112) and the distal end portion (113).

Advantages of Second Variation

According to the scroll compressor of this variation described above, the central portion (111) of the boss portion (11*b*) of the movable scroll (11) has the inner portion (111*a*) made of the first material of which the connection portion (112) is made, and the outer portion (111*b*) made of the second material that is more rigid than the first material. This allows the central portion (111) to be more rigid than the connection portion (112) is. Thus, the same advantages as those of the foregoing embodiment can be provided.

Third Variation

Figure 7:
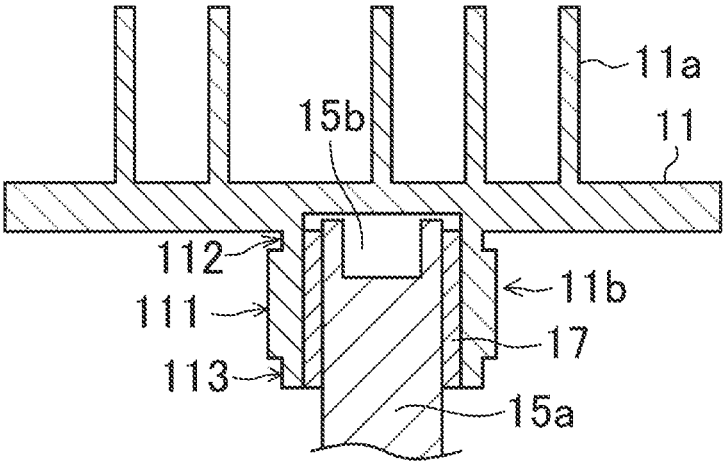
FIG. 7 is a cross-sectional view of a boss portion and its surrounding area of a scroll compressor according to a third variation.
Figure 8:
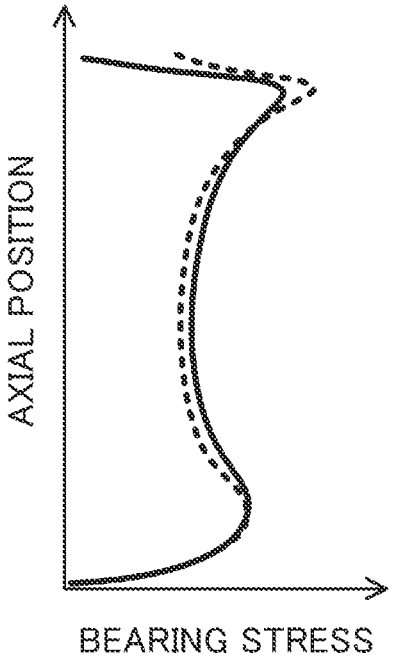
FIG. 8 shows the axial distribution of bearing stress on the boss portion of the scroll compressor illustrated in FIG. 7.

FIG. 7 is a cross-sectional view of a boss portion and its surrounding area of a scroll compressor according to a third variation. It should be noted that, in FIG. 7, the same reference characters are used to designate the same elements as those in the embodiment illustrated in FIG. 1.

The scroll compressor of this variation is distinct from the scroll compressor of the embodiment illustrated in FIG. 1 in that as illustrated in FIG. 7, an end portion of the eccentric shaft portion (15*a*) has a recess (15*b*). Here, the recess (15*b*) overlaps at least the connection portion (112) of the boss portion (11*b*).

Advantages of Third Variation

According to the scroll compressor of this variation described above, the recess (15*b*) formed on the end portion of the eccentric shaft portion (15*a*) allows the end portion of the eccentric shaft portion (15*a*) to be elastic. Thus, even if the eccentric shaft portion (15*a*) under the load associated with the rotational motion of the movable scroll (11) is deformed and is consequently inclined, it is possible to further reduce the degree to which bearing stress increases locally at the connection portion (112) of the boss portion (11*b*). This can further reduce wear and seizure of the sliding bearing (17) near the connection portion (112) of the boss portion (11*b*).

Other Embodiments

In the foregoing embodiment (including the variations), a step is created between each adjacent pair of the central portion (111), connection portion (112), and distal end portion (113) of the boss portion (11*b*) of the movable scroll (11). Alternatively, the thickness of the boss portion (11*b*) may be gently varied from the central portion (111) to the connecting portion (112) or the distal end portion (113).

The connection portion (112) of each of the scroll compressors illustrated in FIGS. 1, 6 and 7 is equal in thickness to the distal end portion (113) thereof. Alternatively, the connection portion (112) and the distal end portion (113) may have different thicknesses within the thickness range less than the thickness of the central portion (111).

It goes without saying that the configuration of the scroll compressor to which the present invention is applicable should not be specifically limited.

While the embodiment and variations have been described above, it will be understood that various changes in form and details can be made without departing from the spirit and scope of the claims. The embodiment, the variations thereof, and the other embodiments may be combined and replaced with each other without deteriorating intended functions of the present disclosure. In addition, the expressions of "first," "second," . . . described above are used to distinguish the terms to which these expressions are given, and do not limit the number and order of the terms.

The present disclosure is useful for a scroll compressor.

The invention claimed is:

1. A scroll compressor comprising:

a scroll compression element including a movable scroll;

a drive shaft configured to allow the movable scroll to rotate;

a boss portion connected to a back surface of the movable scroll, the boss portion being configured to rotatably support an upper end portion of the drive shaft, and the upper end of the drive shaft being configured as an eccentric shaft portion; and a sliding bearing provided between the boss portion and the eccentric shaft portion, an axially central portion of the boss portion being more rigid than a connection portion of the boss portion connected to the movable scroll, the boss portion being shaped so that the axially central portion projects further outward than the connection portion and a distal end portion.

2. The scroll compressor of claim 1, wherein the axially central portion of the boss portion is more rigid than a distal end portion of the boss portion.

3. The scroll compressor of claim 2, wherein the axially central portion of the boss portion is thicker than the connection portion of the boss portion.

4. The scroll compressor of claim 2, wherein the axially central portion of the boss portion has an inner portion made of a first material, and the connection portion of the boss portion is made of the first material, and an outer portion made of a second material that is more rigid than the first material.

5. The scroll compressor of claim 2, wherein an end portion of the eccentric shaft portion has a recess.

6. The scroll compressor of claim 1, wherein the axially central portion of the boss portion is thicker than the connection portion of the boss portion.

7. The scroll compressor of claim 6, wherein an end portion of the eccentric shaft portion has a recess.

8. The scroll compressor of claim 1, wherein the axially central portion of the boss portion has an inner portion made of a first material, and the connection portion of the boss portion is made of the first material, and outer portion made of a second material that is more rigid than the first material.

9. The scroll compressor of claim 8, wherein an end portion of the eccentric shaft portion has a recess.

10. The scroll compressor of claim 1, wherein an end portion of the eccentric shaft portion has a recess.

* * * * *